US007610919B2

(12) United States Patent
Utley et al.

(10) Patent No.: US 7,610,919 B2
(45) Date of Patent: Nov. 3, 2009

(54) INTRAORAL AVERSION DEVICES AND METHODS

(75) Inventors: David Scott Utley, Redwood City, CA (US); Jack Denton Utley, Jr., Fairview, PA (US); Peter Trexler Keith, St. Paul, MN (US); Michael Berman, Minnetonka, MN (US); Robert Emmett Atkinson, White Bear Lake, MN (US)

(73) Assignee: Aetherworks II, Inc., White Bear Lake, MN (US)

( * ) Notice: Subject to any disclaimer, the term of this patent is extended or adjusted under 35 U.S.C. 154(b) by 367 days.

(21) Appl. No.: 10/943,379

(22) Filed: Sep. 17, 2004

(65) Prior Publication Data

US 2005/0263160 A1 Dec. 1, 2005

Related U.S. Application Data

(60) Provisional application No. 60/575,679, filed on May 28, 2004.

(51) Int. Cl.
*A24F 47/00* (2006.01)

(52) U.S. Cl. ..... 131/270; 455/100; 128/138; 128/777; 128/787; 128/848; 128/859; 433/6; 433/32

(58) Field of Classification Search ..... 131/270
See application file for complete search history.

(56) References Cited

U.S. PATENT DOCUMENTS 4,246,913 A * 1/1981 Ogden et al. ..... 131/270
4,629,424 A * 12/1986 Lauks et al. ..... 433/6
5,284,163 A * 2/1994 Knudsen et al. ..... 131/270
5,829,971 A * 11/1998 Razdolsky et al. ..... 433/7
5,841,021 A * 11/1998 De Castro et al. ..... 73/23.2
6,164,278 A * 12/2000 Nissani ..... 128/848
6,544,199 B1 * 4/2003 Morris ..... 600/590

OTHER PUBLICATIONS

A.S McMillan, Reflex inhibition in single motor units of the human lateral pterygoid muscle, 1989, Experimental Brain Research, 76: 97-102.*

* cited by examiner

*Primary Examiner*—Philip C Tucker
*Assistant Examiner*—Phu H Nguyen
(74) *Attorney, Agent, or Firm*—Beck & Tysver PLLC

(57) ABSTRACT

An intraoral aversion device to assist a user in quitting an undesirable behavior such as tobacco smoking, tobacco chewing, use of snuff, illicit drug use, excessive alcohol consumption, excessive food consumption, and/or other undesirable activity facilitated via the mouth. The aversion device may be wholly or partially configured to be disposed in the user's mouth, for example. The aversion device may include a detector and a output device, wherein the detector is configured to detect a parameter indicative of the user engaging in the habit or undesirable activity. If (and only if) the detector detects such a parameter, the output device delivers a negative stimulus to the user, thus providing negative feedback and creating an incentive for the user to limit if not eliminate the undesirable activity.

26 Claims, 8 Drawing Sheets

INTRAORAL AVERSION DEVICES AND METHODS

CROSS REFERENCE TO RELATED APPLICATION

The present application claims the benefit of U.S. Provisional Patent Application No. 60/575,679 filed May 28, 2004, entitled INTRAORAL AVERSION DEVICES AND METHODS, the entire disclosure of which is hereby incorporated by reference.

FIELD OF THE INVENTION

The present invention relates to aversion devices and methods, such as smoking cessation devices and methods.

BACKGROUND OF THE INVENTION

There exist numerous behaviors that are facilitated via the mouth which have serious health consequences. Some of these behaviors include tobacco smoking, illicit drug use, excessive alcohol consumption, and/or excessive food consumption. Unfortunately, the addictive nature of these behaviors creates a great challenge to the afflicted individual if he or she desires to limit or stop such behavior.

Smoking, for example, is a prime example of an addictive behavior with negative health implications. Smoking in all of its forms continues to be a major contributor to serious health problems worldwide. Major health problems related to smoking include various types of cancers, cardiovascular disease, stroke, hypertension, emphysema, chronic bronchitis, asthma, ulcers, and gum disease, among others. Smokers who successfully quit can dramatically reduce their risks for acquiring these health problems.

In the United States alone, approximately 50 million people smoke. It is estimated that 20 million of these individuals make a serious attempt to quit smoking each year. Techniques used to achieve smoking cessation include nicotine replacement, counseling, aversion therapies, hypnosis, pharmacological treatments, and quitting "cold turkey", among others. However, the vast majority of these individuals resume smoking within a few months of their attempted cessation. Even the most successful cessation techniques rarely achieve greater than a ten percent success rate at one year.

Smoking is a powerfully addictive behavior. Successful quitting typically requires tremendous willpower on the part of the individual to keep from resuming the smoking behavior. Certain aversion techniques have been employed with some success. Aversion techniques seek to alter the smoker's psycho-physiological reaction to smoking, from that of a pleasant experience to an unpleasant experience. This may be done by delivery of a negative, unpleasant stimulus to the smoker when he or she smokes.

One aversion technique includes the use of silver acetate tablets taken orally by the smoker. Subsequent smoking causes a reaction between constituents in the smoke and the silver acetate, resulting in a very unpleasant taste. When successfully followed, this technique can modify the smoker's behavior, but this technique requires the individual to willfully continue to consume the tablets on a daily basis. Long-term compliance by the individual is suboptimal with this technique, and therefore this cessation technique is often unsuccessful.

Other aversion cessation techniques similarly allow too much opportunity for the individual to avoid compliance, thus diminishing their associated effectiveness. There is therefore a potential role for an aversion technique (e.g., a smoking cessation technique) that seeks to modify the user's behavior through aversion, while limiting opportunities for non-compliance.

SUMMARY OF THE INVENTION

To address this and other needs, the present invention provides various embodiments of an intraoral aversion device and method. The aversion device may be used, for example, to assist a user in quitting an undesirable activity or habit such as tobacco smoking, tobacco chewing, use of snuff, illicit drug use, excessive alcohol consumption, and/or excessive food consumption, or other undesirable activity facilitated via the mouth. To this end, the aversion device may be wholly or partially configured to be disposed in the user's mouth. If the aversion device is partially configured to be disposed in the user's mouth, then the other portions may be configured to be carried or worn by the patient or implanted in the patient. Placement in the mouth allows the device to readily detect the undesirable activity, limits the ability of the user to remove or defeat the device, and provides easy access for the health care professional.

The aversion device may include a detector and an output device. The detector is configured to detect a parameter that is indicative of the user engaging in the habit or undesirable activity. The output device is configured to generate a signal perceivable by the user or perceivable by someone with influence over the user, such as a delivering a negative stimulus to the user, if the detector detects such a parameter. If the detector does not detect such a parameter, the output device does not generate the signal (e.g., does not deliver a negative stimulus to the user). Thus, the device may deliver a negative stimulus when the user engages in the undesirable activity and may ultimately condition against engagement in the undesirable activity.

Illustrative embodiments of an intraoral aversion device are described in more detail hereinafter.

DETAILED DESCRIPTION OF THE INVENTION

The following detailed description should be read with reference to the drawings in which similar elements in different drawings are numbered the same. The drawings, which are not necessarily to scale, depict illustrative embodiments and are not intended to limit the scope of the invention.

Figure 1:
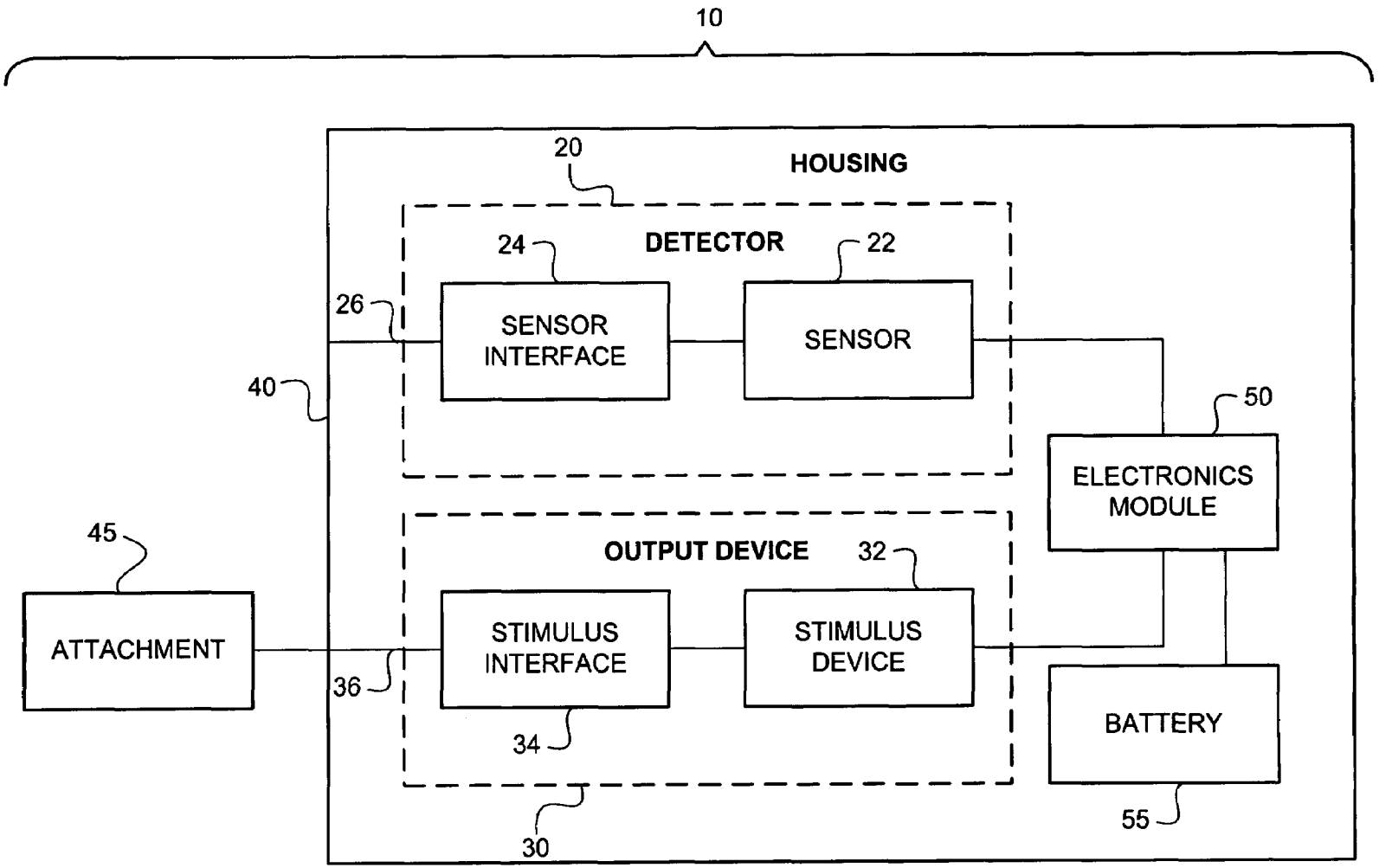
FIG. 1 is a schematic block diagram of a generic embodiment of an intraoral aversion device.

With reference to FIG. 1, an aversion device 10 is shown schematically by block diagram. The aversion device 10 may be used, for example, to assist a user in quitting a habit or undesirable activity such as tobacco smoking. The aversion device 10 may be wholly or partially configured to be disposed in the user (e.g., oral cavity) to improve patient compliance by limiting the user's ability to remove or defeat the functionality of the device 10. The aversion device 10 may include a detector 20 operably connected to an output device 30. The detector 20 may detect a parameter that is indicative of the user engaging in the habit or undesirable activity. If the detector 20 detects a parameter indicative of the user engaging in an undesirable activity, the output device 30 may generate a signal perceivable by the user or perceivable by someone with influence over the user, such as delivering a negative stimulus to the user. Thus, the intraoral aversion device 10 may deliver a negative stimulus to the user when the user engages in the undesirable activity, and may ultimately condition against engagement in the undesirable activity.

The aversion device 10 may be used, for example, to assist a user in quitting an undesirable behavior such as tobacco smoking, tobacco chewing, use of snuff, illicit drug use, excessive alcohol consumption, and/or excessive food consumption, or other undesirable activity facilitated via the mouth. To this end, the aversion device 10 may be wholly or partially configured to be disposed in the user's mouth, for example. Placement in the mouth allows the device 10 to readily detect the habit or undesirable activity facilitated therethrough, and deliver an adverse stimulus therein. Placement in the mouth also limits the user's ability to remove or defeat the device 10, thus improving patient compliance. Placement in the mouth further provides the health care professional ready access to place the device 10 in the user.

To facilitate placement in the user, at least one of and preferably both of the detector 20 and the output device 30 may be disposed in a housing 40 configured to be disposed in a cavity of the user (e.g., oral cavity) or configured for implantation in the user. For example, the housing 40 may comprise a biocompatible material (e.g., stainless steel, polycarbonate, silicone) and may be sealed (water resistant, water proof, or hermetic) to protect the internal components from the harsh environment inside the mouth. If the detector 20 is disposed in the housing 40, the housing 40 may include a communication path (e.g., opening) to permit the detector 20 to detect the subject parameter in the mouth.

To further facilitate placement, the device 10 may include one or more attachments 45 to connect the housing 40 to an anatomical feature in the user's mouth, such as one or more teeth or bony structure therein. The attachment 45 may comprise one or more tooth clasps, wires, bonding agents, modified bridge or crown, or other mounting devices conventionally used to fix orthodontic appliances in the mouth. The attachment 45 may be fixedly secured to the anatomical structure using conventional dental tools and techniques such that it is easy for a dentist to place or remove the device 10, but it is difficult for the user to do so. Further attachment 45 options are described hereinafter.

The attachments 45 may be separate or integral with the remainder of the device 10. For example, if separate, the attachment may be secured in the user's oral cavity, and the remainder of the device 10 may be subsequently connected thereto. Such a connection may be made releasable such that the remainder of the device 10 may be removed and replaced, for example, while leaving the attachments in place.

The detector 20 may include a sensor 22, which may be selected to be sensitive to the parameter of interest. For example, if the undesirable activity is tobacco smoking, the sensor 22 may be responsive to the presence of one or more constituents of tobacco smoke (e.g., an electrochemical gas sensor or IR spectroscopic analyzer), the presence of smoke particulate (e.g., an ionizing radiation or photoelectric smoke detector), the presence of a vacuum in the oral cavity during inhalation of smoke (e.g., a pressure sensor or switch), or a combination thereof. If the undesirable activity is illicit drug use or excessive alcohol consumption, the sensor 22 may be responsive to the presence of one or more constituents of the illicit drug or alcohol in the oral cavity before inhalation or swallowing, or in the exhaled breath (e.g., photoelectric sensor with reagent strip color change). If the undesirable activity is excessive food consumption, the sensor 22 may be responsive to the type of food (fat or sugar products), osmolality, the amount of food, and/or the caloric value of food consumed (e.g., ultrasonic sensor with glucose meter).

The detector 20 may also include a sensor interface 24 which is configured to permit the sensor 22 to sense the parameter of interest in the target substance, but prevent the ingress of the target substance or other foreign matter into the sensor 22 or the housing 40. The sensor interface 24 may communicate through the housing 40, may comprise all or a portion of the housing 40, or may be connected thereto by interconnection 26. For example, the sensor interface 24 may be configured to communicate with the oral cavity, and/or to contact saliva or oral tissues, while preventing saliva, drinks, foods, and other forms of gases, liquids and/or solids from entering the sensor 22 or housing 40. For most sensor applications, the interface 24 may be permeable to the target substance (e.g., inhaled or exhaled breath) and/or the interrogating means (e.g., electromagnetic radiation, light, pressure) while being impermeable to other substances.

For example, if the sensor 22 comprises an electrochemical gas sensor, the sensor interface 24 may comprise a membrane and/or filter that permits the ingress of certain gaseous substances from the oral cavity while preventing the ingress of liquids, solids and contaminating gaseous substances. Alternatively, if the sensor 22 comprises an IR spectrometer, the sensor interface 24 may comprise a fluid sealed IR transparent window, and/or a membrane permitting the passage of gaseous substances only. If the sensor 22 comprises a photoelectric smoke detector, the sensor interface 24 may comprise a fluid sealed light transparent window, and/or a filter permitting the passage of gaseous substances and smoke particulate only. If the sensor 22 comprises an ionizing radiation smoke detector, the sensor interface 24 may comprise a fluid sealed barrier with low electromagnetic attenuation (e.g., non-metallic, polymeric, glass, ceramic), and/or a filter permitting the passage of gaseous substances and smoke particulate only. If the sensor 22 comprises a pressure sensor or switch, the sensor interface may comprise a fluid sealed diaphragm. If the sensor 22 comprises a photoelectric sensor with reagent color change, the sensor interface 24 may comprise a fluid sealed light transparent window for the photoelectric sensor and a membrane or filter for the reagent strip.

In some instances, the sensor 22 and/or the sensor interface 24 may be single use or may become less effective over time. For example, reagent strips usually undergo a color change in the presence of the target parameter, but do not change back to their original color. Accordingly, the sensor 22 and/or the sensor interface 24 may be configured for removal and replacement. For example, the sensor 22 and/or the sensor interface 24 may comprise a replaceable cartridge. Other portions of the device 10 may be similarly configured for replacement, including, without limitation, the output device 30 and the battery 55.

The output device 30 may include a stimulating device 32 which may be selected to generate one or more effective signals that are perceivable by the user or perceivable by someone with influence over the user, such as negative stimuli delivered to the user. The negative stimulus may comprise an electrical, mechanical, chemical, thermal, audible, or visible stimulus, for example, or a combination thereof. The stimulating device 32 may be made adjustable and/or programmable (regressively or progressively) to suit the user and the particular application.

For electrical stimulus, the stimulating device 32 may comprise an electrical circuit that delivers an unpleasant or painful electrical pulse (e.g., shock) or series of pulses (e.g., pulse train) to the user via the housing 40 and/or attachment 45. For mechanical stimulus, the stimulating device 32 may comprise a vibrator that delivers an unpleasant or painful vibration to the user via the housing 40 and/or attachment 45. For chemical stimulus, the stimulating device 32 may comprise a miniature pump that secrets an agent (e.g., hydrogen sulfide, acetic acid) that is unpleasant to smell or taste, or that secretes an agent that is painful (e.g., capsaicin). For thermal stimulus, the stimulating device 32 may comprise a resistive heating element to deliver hot stimulus or a Peltier device that delivers hot or cold stimulus to thermally sensitive areas in the mouth. For audible stimulus, the stimulating device 32 may comprise an acoustic transducer (e.g., speaker) that generates an irritating or embarrassing noise. For visible stimulus, the stimulating device 32 may comprise a light source (e.g., light bulb or light emitting diode) that generates sufficient light to be noticeable to the user and/or people around the user such that the user is irritated or embarrassed.

The output device 30 may also include a stimulator interface 34. The stimulator interface 34 provides a path from the stimulus device 32 to the target site for the stimulus. The stimulus interface 34 may comprise a discrete component, may be connected to the housing 40 and/or attachment 45 via interconnection 36, or may comprise the housing 40 and/or attachment 45. For example, for electrical stimulus, the stimulator interface 34 may comprise electrodes for attachment to one or more teeth or other tissues in the mouth, and the attachment 45 may serve as such electrodes. For chemical stimulus, the stimulator interface 34 may comprise a diffusion tube or pad for attachment to the tongue, gums or other tissues in the mouth. For thermal stimulus, the stimulus interface 34 may comprise a thermal contact. For some forms of stimulus, such as audible and visible stimulus, a stimulus interface 34 may not be necessary.

The output device 30 may incorporate a single stimulating device 32 and a single stimulus interface 34, a single stimulating device 32 and multiple stimulus interfaces 34, or multiple stimulating devices 32 with multiple stimulus interfaces 34. Similarly, the detector 20 may incorporate a single sensor 22 and a single sensor interface 24, a single sensor 22 and multiple sensor interfaces 24, or multiple sensors 22 with multiple sensor interfaces 24. The use of multiple interfaces 24, 34 reduces the likelihood of the user successfully defeating functionality of the device 10.

The aversion device 10 may further include an electronics module 50 disposed in the housing 40 to control the sensor 22 and stimulation device 32. Electrical power may be provided to the electronics module 50, and to the sensor 22 and stimulation device 32 via electronics module 50, by battery 55. As those skilled in the art will recognize, the electronics module 50 will vary depending on the particular detector 20 and output device 30 utilized. Generally, the electronics module 50 samples for the target parameter using the detector 20 and triggers a negative stimulus using the output device 30. For example, the electronics module 50 may operate to perform the processes described with reference to FIGS. 5-8. These processes may be embedded in hardware, software or firmware, and the electronics module 50 may be configured accordingly. For software and firmware modes, a program may be used to define the processes, and the electronics module 50 may include a processor for executing the program connected to a memory device for storing the program.

Figure 2:
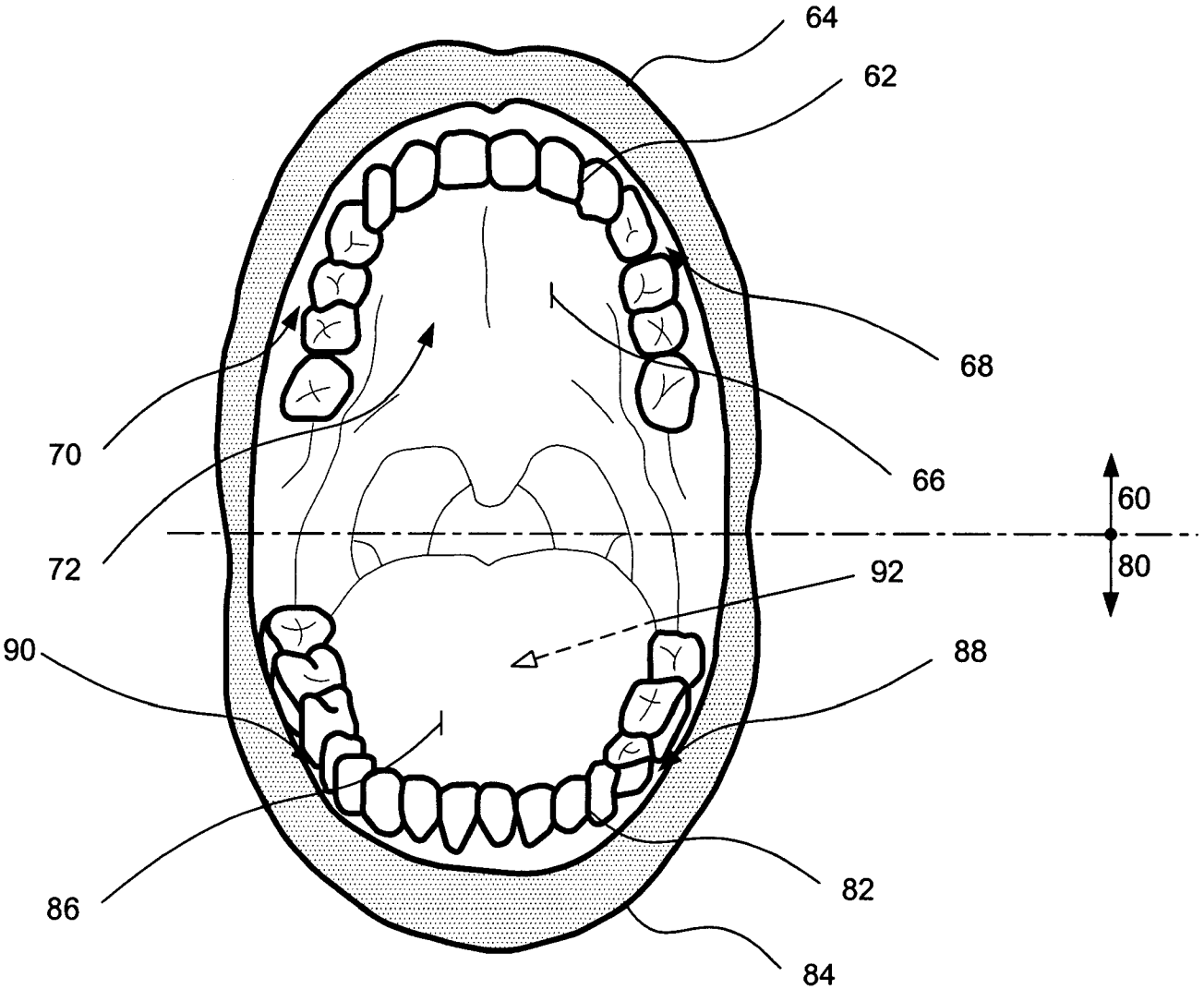
FIG. 2 is a schematic illustration showing various possible locations in the mouth to place the aversion device illustrated in FIG. 1.

With reference to FIG. 2, various possible placement locations for the aversion device 10 are shown and described. To facilitate a description of suitable placement locations for device 10, an anatomical description of the mouth follows.

FIG. 2 illustrates an open mouth or oral cavity, including an upper portion 60 and a lower portion 80. The upper portion 60 includes upper teeth 62, an upper lip 64, and a palate 66. The spaces between the upper lip 64 and the upper teeth 62 are the upper left and the upper right gingival-buccal and dental-buccal spaces (collectively referred to herein as upper buccal spaces 68, 70). The space adjacent the palate 66 is the palatal space 72. The lower portion 80 includes lower teeth 82, a lower lip 84, and a tongue 86. The spaces between the lower lip 84 and the lower teeth 82 are the lower left and the lower right gingival-buccal and dental-buccal spaces (collectively referred to herein as lower buccal spaces 88, 90). The space beneath the tongue 86 is the sublingual space 92.

The device 10 may be disposed in a portion of the oral cavity that provides access to the target substance containing the target parameter, that does not significantly compromise oral function (e.g., breathing, eating, drinking, speaking, etc.), and that does not cause trauma to or otherwise modify oral anatomy. Examples of suitable placement locations for all or portions of device 10 include the upper left or upper right buccal spaces 68, 70, the palatal space 72, the lower left or lower right buccal spaces 88, 90, and the sublingual space 92.

With reference to FIGS. 3A-3D, various possible attachment locations for the aversion device 10 are shown and described. FIGS. 3A-3D are intended to generically refer to either the upper teeth 62 or the lower teeth 82. By way of example, not limitation, the attachment locations are described with respect to upper teeth 62, but may also be applied to the lower teeth 82. The upper teeth 62 include the central incisor 100, lateral incisor 102, canine 104, first bicuspid 106, second bicuspid 108, first molar 110, and second molar 112. Some people also possess third molars (wisdom teeth), which are not shown. As the upper teeth 62 are generally symmetric, the left and right sides each include the above mentioned types of teeth.

Generally, the device 10 may be attached to the user's teeth or bony structure in the oral cavity using an attachment device 45 as shown and described with reference to FIG. 1. For tooth-based fixation, the attachment point or points may be lingual or buccal for tooth-based fixation, depending on the desired location of the device. The device 10 may have 1-2 mm of clearance from all mucosal structures (like the palate) for better sensing and hygiene. By way of example not limitation, the attachment 45 may comprise an orthodontic molar and/or bicuspid band; a direct bonded bracket, pad, or other device; a clasp (as used in an orthodontic retainer) that traverses the embrasure (area between teeth) affixed with an adhesive product or not fixated; interdental wire or bar; and/or labial bow wire (with anterior fixation) affixed to the enamel with an adhesive product or not fixated. For bony structure fixation, bone screw(s) may be placed in hard palate, maxilla, mandible or other bony structure.

Figure 3A:
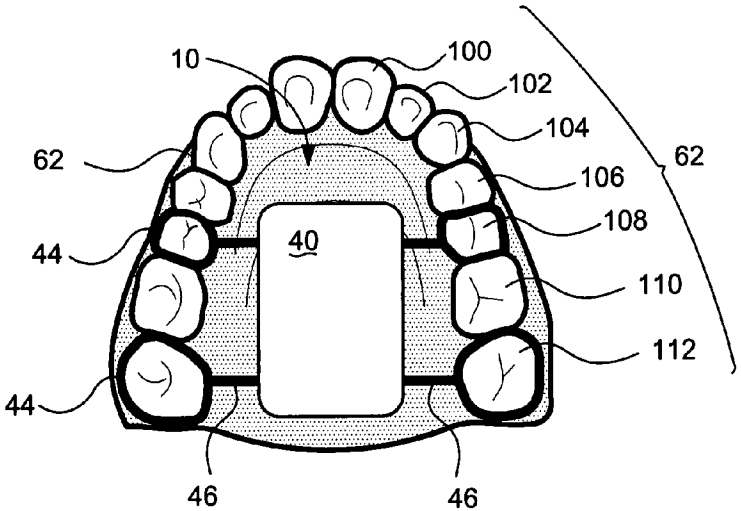
FIGS. 3A-3D are schematic illustrations showing various possible attachment points for the aversion device illustrated in FIG. 1.
Figure 3B:
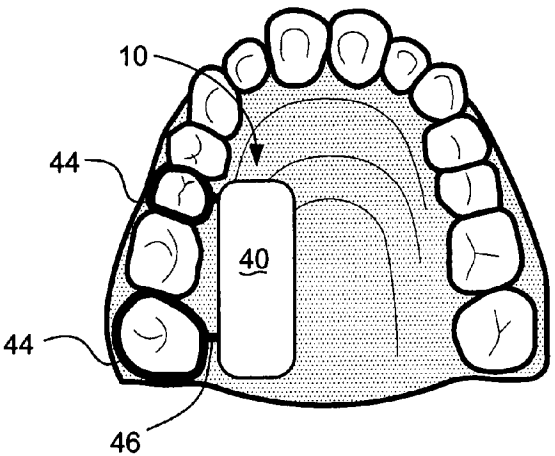
Figure 3C:
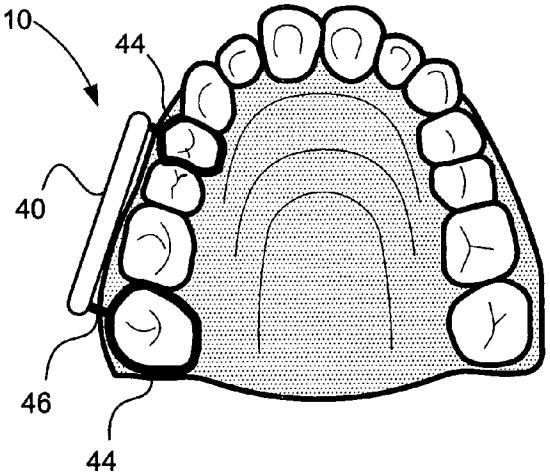
Figure 3D:
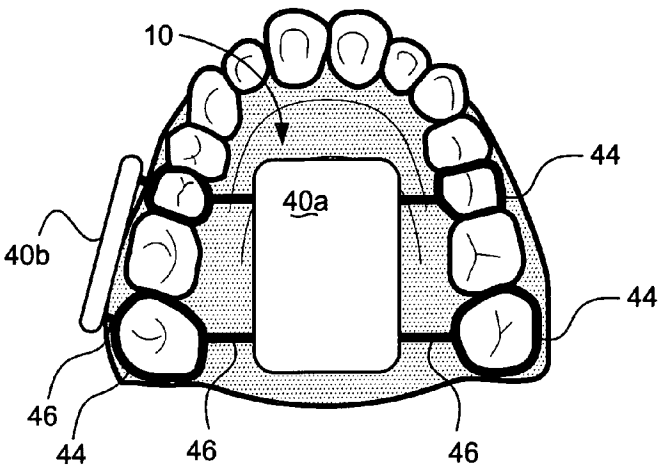

In the examples illustrated in FIGS. 3A-3D, the attachment 45 is shown to comprise a clasp 44 connected to the housing 40 by a connector 46, but may comprise other attachment means such as wire, bonding agent, modified bridge or crown, etc. The device 10 may be attached bilaterally as shown in FIGS. 3A and 3D, or unilaterally as shown in FIGS. 3B and 3C. The device 10 may be disposed on the palatal side of the teeth 62 as shown in FIGS. 3A and 3B, on the buccal side of the teeth 62 as shown in FIG. 3C, or on both sides of the teeth 62 as shown in FIG. 3D.

FIG. 3A shows an arrangement in which the device 10 is positioned in the palatal space 72 (or the sublingual space 92), and is attached bilaterally to one or more of the teeth 62 on each side of the mouth. As shown, the device 10 is connected to four teeth, left and right second bicuspids 108, and left and right second molars 112. It is contemplated that the device 10 could be attached to any combination of the teeth 62. The attachment illustrated comprises clasp 44 and connector 46 between clasp 44 and housing 40. Clasp 44 may comprise a circumferential band, such as that used commonly in orthodontic appliances. Connector 46 can be a metallic structure such as a wire. Depending on the size and shape of the housing 40, a connector 46 may not be necessary, in which case the clasp 44 may be directly connected to the housing 42. Alternatively the housing 40 (and connector 46) may be attached to one or more of the teeth 62 by means of an adhesive bond such as is commonly used to affix orthodontic braces to the teeth.

FIGS. 3B and 3C show arrangements wherein the device 10 is connected unilaterally on one side (left or right) of the teeth 62. The device 10 may be disposed in the palatal space 72 (or sublingual space 92) as illustrated in FIG. 3B, or in any of the upper buccal spaces 68, 72 (or lower buccal spaces 88, 90) as shown in FIG. 3C.

Alternatively, the device 10 may be disposed in both the palatal space 72 (or sublingual space 92) and one of the upper buccal spaces 68, 70 (or lower buccal spaces 88, 90), as shown in FIG. 3D. To this end, the device 10 may be partitioned into two (or more) discrete portions having multiple housings 40*a*, 40*b* as shown in FIG. 3D, rather than utilizing a unitary housing 40 as shown in FIGS. 3A-3C. For example, the detector 30, electronic module 50 and battery 55 may be disposed in housing 40*a*, and the output device 30 may be disposed in housing 40*b*, with electrical interconnections therebetween being provided via connectors 46. Any number of attachments 45 (and housings 40) are contemplated for device 10 to make use of any number and combination of the placement locations previously described.

With reference to FIGS. 4A-4D, various possible sensor orientations for the aversion device 10 are shown and described. FIGS. 4A-4D are intended to generically refer to either the upper portion 60 or the lower portion 80 of the mouth. By way of example, not limitation, the sensor orientations are described with respect to the upper portion 60, but may also be applied to the lower portion 80.

Generally, the detector 20 may incorporate a single sensor 22 and a single sensor interface 24, a single sensor 22 and multiple sensor interfaces 24, or multiple sensors 22 with multiple sensor interfaces 24. FIGS. 4A-4D show devices 10 utilizing multiple sensor interfaces 24 to provide multiple sampling sites which increases the likelihood of successful detection and reduces the likelihood of the user successfully defeating functionality of the device 10. The orientations illustrated in FIGS. 4A-4D may be applied to single or multiple sensor interfaces 24, and may be taken alone or in combination.

Figure 4C:
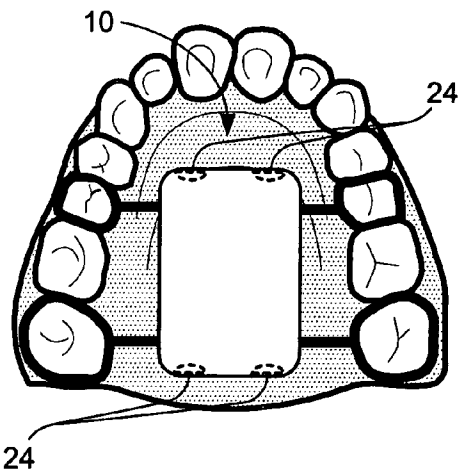
FIGS. 4A-4D are schematic illustrations showing various possible sensor orientations for the aversion device illustrated in FIG. 1.
Figure 4D:
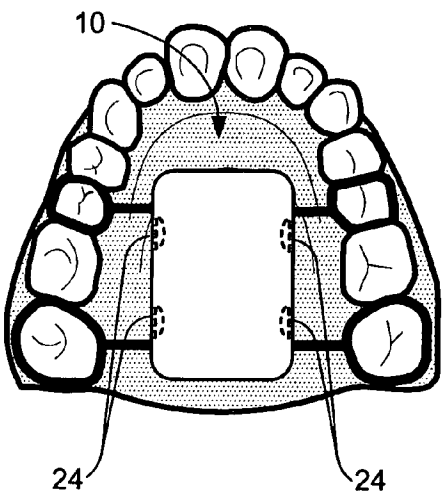
Figure 4A:
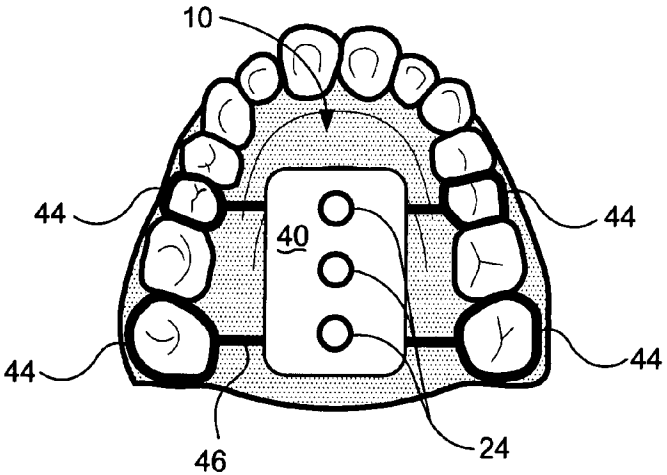
Figure 4B:
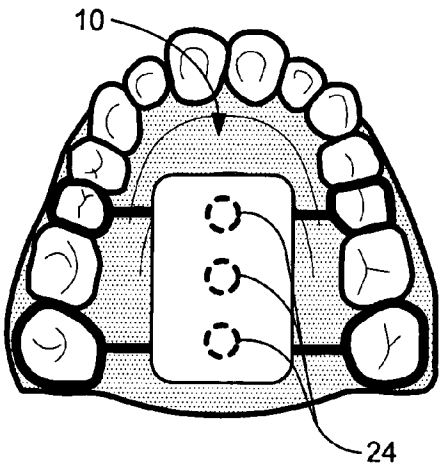

In FIG. 4A, the device 10 is disposed in the palatal space 72 adjacent the palate 66 with the sensor interfaces 24 facing inferiorly (towards tongue). In FIG. 4B, the device 10 is disposed in the palatal space 72 spaced from the palate 66 with the sensor interfaces 24 facing superiorly (towards the palate 66). In FIG. 4C, the sensor interfaces 24 face anteriorly and/or posteriorly (front/back), and in FIG. 4D, the sensor interfaces 24 face laterally (right/left).

These orientations may be taken alone or in any combination, may be applied to a device 10 in any placement position (palatal, lingual, buccal), and may be applied to a device 10 with any attachment location. Generally, sensor interface 24 orientations that are less accessible to the user (and thus better protected from user defeat) may also have less access to the target substance and the target parameter. Thus, the number and orientation of the sensor interfaces 24 may be selected to balance the likelihood of successful detection with the likelihood of user defeat.

With reference to FIGS. 5-8, various methods of using the aversion device 10 are shown by flow chart. These processes may be embedded in hardware, software or firmware, and may be executed by the electronics module 50 as described previously. In general, the detector 20 samples the target parameter (X) in the target substance in the oral cavity and measures the parameter for comparison to a certain threshold (T). If the measured parameter exceeds the threshold, the output device 30 delivers the negative stimulus to the user. Preferably, the detector 20 measures the parameter with sufficient selectivity, sensitivity and accuracy to minimize false positives and false negatives. To this end, the parameter or parameters selected for measurement are preferably indicative of and unique to the habit or undesirable activity, relative to other activities facilitated via the oral cavity (e.g., eating, drinking, breathing, etc.).

If the stimulus is triggered on, the stimulus may be triggered off when the measured parameter ceases to exceed the threshold (i.e., stimulus continuously delivered until the measured parameter does not exceed the threshold) as shown and described with reference to FIG. 5. Alternatively, if the stimulus is triggered on, the stimulus may be triggered off after a preset period of time as shown and described with reference to FIG. 6. For purposes of determining the stimulus trigger (on and off), the measured parameter (X) may be compared to the threshold (T), or a time derivative (dX/dt) of the measured parameter may be compared to the threshold (T) as shown and described with reference to FIG. 7. Also for purposes of determining the stimulus trigger (on and off), the threshold (T) may be a constant value (k), or may be a function of the measured parameter (X), the number of times (n) the detector 20 has detected the parameter (X), the amount of time (t) the detector 20 has detected the parameter (X), and/or the amount of time the device has been disposed in the oral cavity, as shown and described with reference to FIG. 8. Each of the variants described with reference to FIGS. 5-8 may be taken alone or in any combination.

Figure 5:
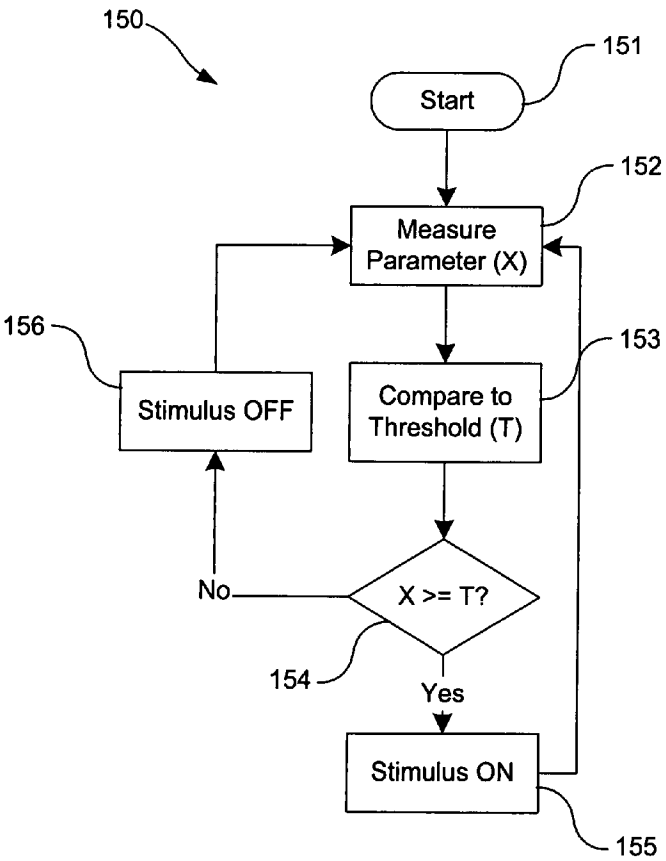

With specific reference to FIG. 5, a method 150 of using the aversion device 10 is shown by flow chart. This method 150 generally calls for the stimulus to be continuously delivered as long as the detected parameter (X) exceeds the threshold (T). The method 150 starts 151 by the detector 20 sampling and measuring 152 the target substance containing the target parameter (X). The measured parameter (X) is compared 153 to the threshold (T) to determine 154 if the measured parameter (X) is equal to or exceeds the threshold (T). If the measured parameter (X) is greater than or equal to the threshold (T), the output device 30 is triggered ON 155 to deliver the negative stimulus to the user. If the measured parameter (X) is not greater than or equal to the threshold (T), the output device 30 is triggered OFF 156 (if it is not already off). In either case, the detector 20 continues to sample and measure 152 the parameter (X) and make comparisons 153 to the threshold (T) to determine 154 if the measured parameter (X) is greater than or equal to the threshold (T). Thus, if the stimulus is triggered ON 155, the stimulus is subsequently triggered OFF 156 when the measured parameter (X) ceases to exceed the threshold (T).

Figure 6:
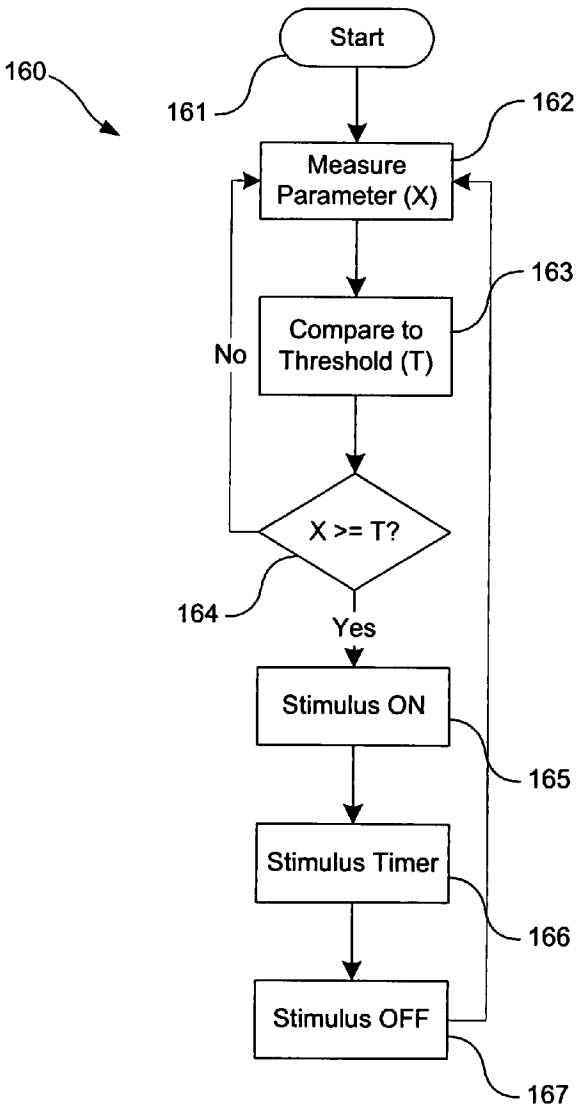
FIGS. 5-8 are flow charts illustrating various methods of using the aversion device illustrated in FIG. 1.

With specific reference to FIG. 6, another method 160 of using the aversion device 10 is shown by flow chart. This method 160 generally calls for the stimulus to be delivered for a set period of time after the detected parameter (X) exceeds the threshold (T). The method 160 starts 161 by the detector 20 sampling and measuring 162 the target substance containing the target parameter (X). The measured parameter (X) is compared 163 to the threshold (T) to determine 164 if the measured parameter (X) is equal to or exceeds the threshold (T). If the measured parameter (X) is greater than or equal to the threshold (T), the output device 30 is triggered ON 165 to deliver the negative stimulus to the user. Once the output device 30 is triggered ON 165, a time delay is initiated 166. The timer is preset to the desired amount of time the stimulus is to be delivered, which may be fixed or variable. Once the time delay is complete, the output device 30 is triggered OFF 167 and the sequence begins again at 162. Thus, the stimulus is delivered for a set period of time once the detected parameter (X) exceeds the threshold (T).

Figure 7:
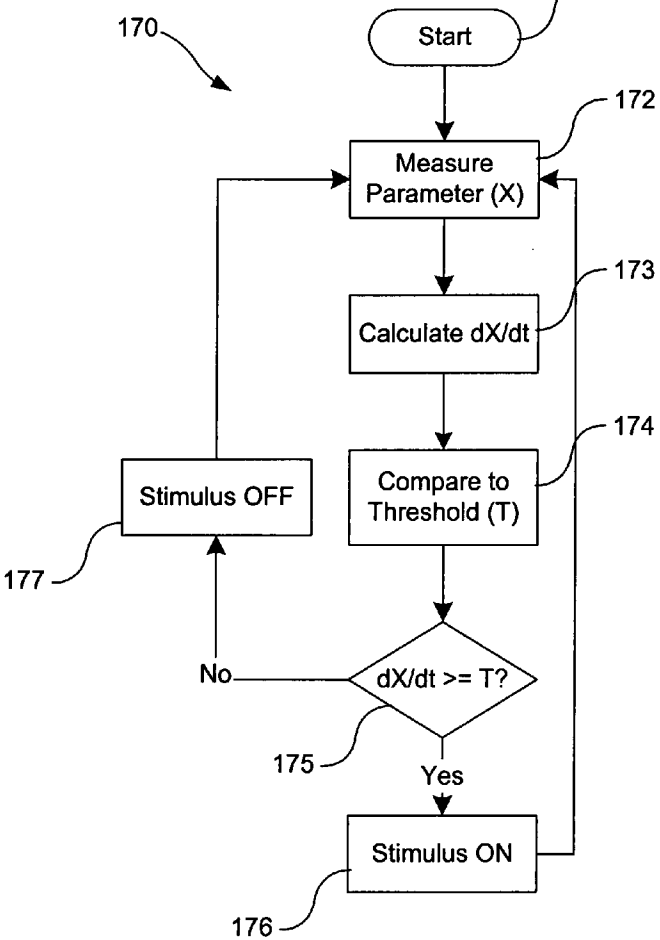

With specific reference to FIG. 7, yet another method 170 of using the aversion device 10 is shown by flow chart. This method 170 generally calls for a time derivative (dX/dt) of the measured parameter (X) to be compared to the threshold (T), rather than simply comparing the measured parameter (X) to the threshold (T). The method 170 starts 171 by the detector 20 sampling and measuring 172 the target substance containing the target parameter (X). The time derivative (dX/dt) of the measured parameter (X) is calculated 173, wherein dX may correspond to the change in the measured parameter from the immediately prior measurement, and dt may correspond to the elapsed time from the immediately prior measurement or any other suitable time increment. The time derivative calculation 173 may require the use of a timer routine and an initial measurement which are not illustrated in FIG. 7. The measured parameter time derivative (dX/dt) of the measured parameter (X) is then compared 174 to the threshold (T) to determine 175 if the time derivative (dX/dt) of the measured parameter (X) is equal to or exceeds the threshold (T). The remainder of the method 170 (trigger ON step 176 and trigger OFF step 177) may be the same as those described with reference to method 150 or method 160 described previously.

Figure 8:
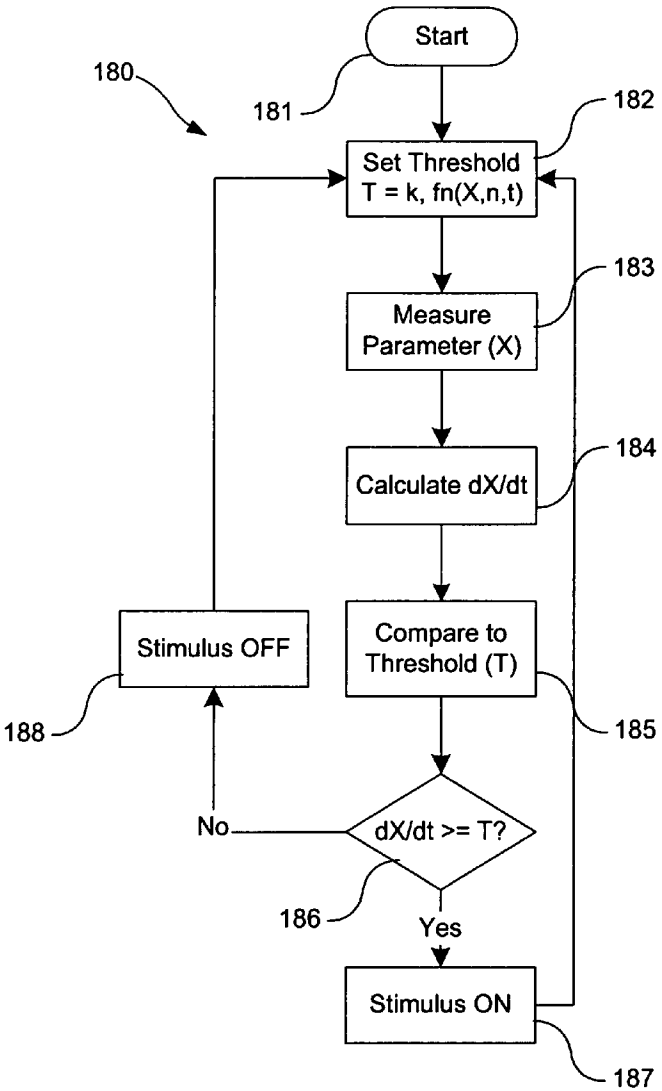

With specific reference to FIG. 8, yet another method 180 of using the aversion device 10 is shown by flow chart. This method 180 generally illustrates that the threshold (T) may be fixed or variable. For example, the threshold (T) may be a constant value (k) preset by the manufacturer, that may be optionally modified by a physician. Alternatively, the threshold (T) may be a function of the measured parameter (X), the number of times (n) the stimulus has been triggered, and/or the amount of time (t) the measured parameter (X) is equal to or exceeds the threshold (T). For example, if the stimulus has been triggered several times (e.g., n>2), then the threshold (T) may be reduced to mitigate against continued engagement in the undesirable activity. Alternatively, if the measured parameter (X) is equal to or exceeds the threshold (T) for an extended period of time (e.g., t>60 seconds), then the threshold (T) may be reduced to mitigate against continued engagement in the undesirable activity.

With continued reference to FIG. 8, the method 180 may be similar to method 170 with the exception of step 182 wherein the threshold (T) is set. Specifically, the method 180 starts 181 with the setting 182 the threshold (T) to be equal to a constant value (k), or to some function of X, n, or t. If the threshold (T) is a function of X, n or t, then the threshold may be initially set to a temporary value since the variables (X, n, and t) will initially be zero or undetermined. The detector 20 then samples and measures 183 the target substance containing the target parameter (X). The time derivative (dX/dt) of the measured parameter (X) is calculated 184 and compared 185 to the threshold (T) to determine 186 if the time derivative (dX/dt) of the measured parameter (X) is equal to or exceeds the threshold (T). The remainder of the method 180 (trigger ON step 187 and trigger OFF step 188) may be the same as those described with reference to method 170 described previously.

In a similar manner, the stimulus (S) may be a constant value (e.g., mild, medium or strong) or variable. The stimulus (S) may vary as a function of the measured parameter (X), the number of times (n) the detector 20 has detected the parameter (X), the amount of time ($t_1$) the detector 20 has detected the parameter (X), and/or the amount of time ($t_2$) the device has been disposed in the oral cavity. If the stimulus (S) is a function of X, n or t, then the stimulus (S) may be initially set to a temporary value (e.g., mild, medium or strong) since the variables (X, n, and t) will initially be zero or undetermined. In the variable mode, the stimulus (S) may be a progressive function of X, n, $t_1$, or $1/t_2$, or a regressive function of $t_2$, 1/X, 1/n, or $1/t_1$.

The preceding description is generically directed to aversion devices and methods that assist a user in quitting an undesirable activity facilitated via the mouth, such as tobacco smoking, illicit drug use, excessive alcohol consumption, and excessive food consumption. To facilitate further discussion, the intraoral aversion device 10 is described with specific reference to a tobacco smoke aversion device 10, but the same or similar principles may be applied to other undesirable activities facilitated via the mouth.

For a tobacco smoke aversion device 10, the sensor 22 may be responsive to the presence of one or more gas or particulate constituents of tobacco smoke (e.g., an electrochemical gas sensor or IR spectroscopic analyzer), the presence of smoke particulate (e.g., an ionizing radiation or photoelectric smoke detector), the presence of a vacuum in the oral cavity during inhalation of smoke (e.g., a pressure sensor or switch), or a combination thereof. For a sensor 22 that detects a constituent of tobacco smoke, suitable constituents (i.e., the target parameter (X)) include high levels (levels higher than ambient conditions) of carbon dioxide, carbon monoxide, nitrogen oxides, ammonia, nicotine, acetone, acetaldehyde, formaldehyde, hydrogen cyanide, isoprene, methyl ethyl ketone, benzene, toluene, phenol, acrylonitrile, and other chemicals found in tobacco smoke.

The following embodiments focus on an electrochemical sensor 22 that is sensitive to the presence of carbon monoxide, but the same or similar principles may be applied to other sensors for detecting other constituents of tobacco smoke as listed above. Thus, in the following embodiments, the sensor 22 comprises an electrochemical carbon monoxide gas sensor, the target parameter (X) comprises carbon monoxide and the threshold (T) may comprise 30 ppm, for example.

Figure 9A:
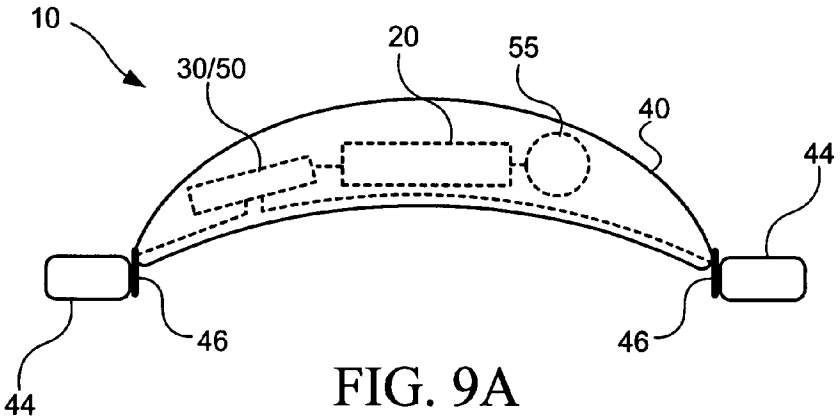
FIGS. 9A-9B are posterior and inferior views, respectively, of a smoking aversion device configured to be disposed in the palatal space and attachment to a plurality of teeth.
Figure 9B:
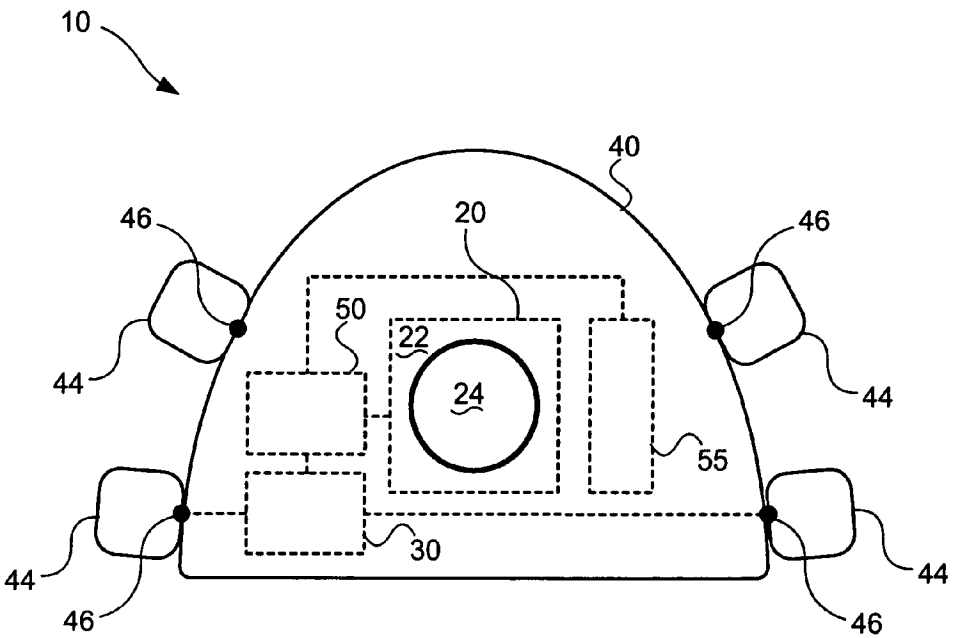

With reference to FIGS. 9A-9B, a smoking aversion device 10 configured to be disposed in the palatal space 72 and attachment to a plurality of teeth 62 is shown schematically. Specifically, FIG. 9A is a rear view of the device 10, and FIG. 9B is a bottom view of the device 10. Smoking aversion device 10 includes a detector 20 (including sensor 22 and sensor interface 24), output device 30, housing 40, attachment 45 (comprising clasps 44 and wires 46), electronics module 50 and battery 55.

To facilitate placement in the oral cavity, the housing 40 of the device 10 may be shaped to fit comfortably within the oral cavity and conform to anatomical structures therein. In the illustrated embodiment, for example, the housing 40 may be shaped to fit adjacent to the palate 66 in the palatal space 72, while having a low profile (height) to avoid interference with oral function. The housing 40 may be attached to the teeth 62 via connectors 46 and clasps 44 that engage four of the upper teeth 62.

The internal components, including detector 20, output device 30, electronics module 50 and battery 55, may be arranged side-by-side as shown to minimize profile. The sensor 22 is arranged to interact with inhaled or exhaled smoke within the oral cavity via the sensor interface 24 disposed in an opening in the housing 40, examples of which are described in more detail with reference to FIGS. 10A-10C. The output device 30 delivers an electrical stimulus to the teeth 62 via electrical connection 36, connectors 46 and clasps 44.

Figure 10A:
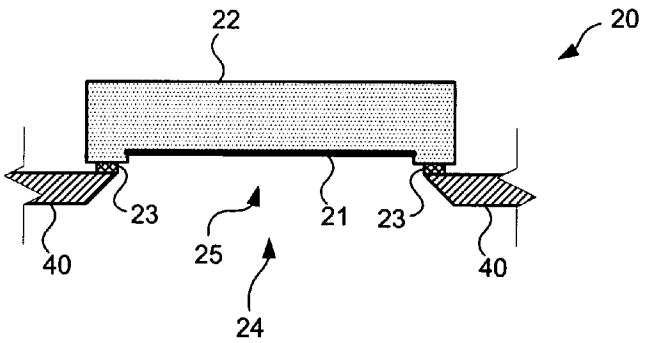
FIGS. 10A-10C are cross sectional views of various sensor interface arrangements for the smoking aversion device illustrated in FIGS. 9A-9B.
Figure 10B:
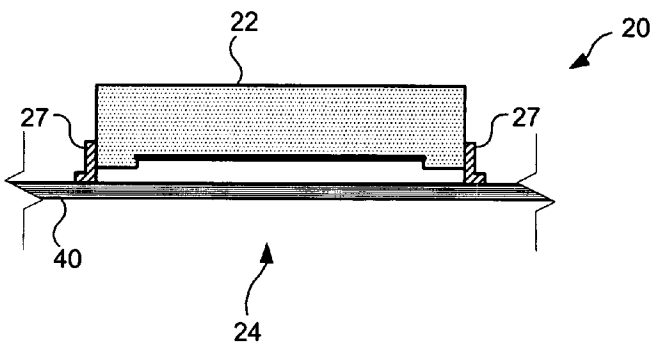
Figure 10C:
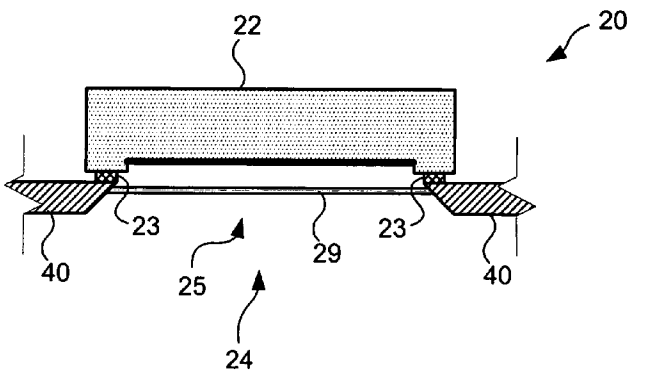

With reference to FIGS. 10A-10C, various sensor 22 and sensor interface 24 arrangements are shown in cross sectional view. The sensor interface 24 arrangement influences the way that carbon monoxide is detected by the sensor 22. As mentioned before, the sensor 22 may comprise a miniature electrochemical gas sensor, examples of which are commercially available from Alphasense of Essex, UK and City Technology of Hampshire, UK. Such electrochemical gas sensors are quite accurate, and can measure the presence of gases to low levels such as a few parts per million (ppm).

Electrochemical gas sensors typically include a gas permeable sensor membrane 21 which contains an electrolytic chemical agent (not shown) within the sensor 22. In the case of a carbon monoxide sensor, this electrolyte is typically an acid such as sulfuric acid. A working electrode (not shown) made of a catalyst such as platinum is in contact with the electrolyte, as well as a counter electrode (also not shown). Molecules of the constituent gas (carbon monoxide) diffuse through the gas permeable sensor membrane 21, and react with the electrolyte and the working electrode, generating an electromotive force between the working electrode and the counter electrode.

With specific reference to FIG. 10A, a sensor interface 24 is shown wherein the sensor membrane 21 is directly exposed to the oral cavity, by means of an opening 25 in the housing 40. A seal 23 between the sensor 22 and housing 40 keeps saliva and other liquid or solid contents in the oral cavity from entering the interior of the detector 20. The arrangement of FIG. 10A may be highly sensitive and responsive to exposure of the constituent gas within the oral cavity. However, if food or saliva completely covers the sensor membrane 21, gas diffusion into the sensor 22 may be compromised. Also, certain types of electrochemical sensors may be sensitive to being covered in liquid water.

To address these issues, the sensor interface 24 may comprise all or a portion of the housing 40 as shown in FIG. 10B. In this embodiment, the housing may be fabricated from a gas permeable material, such as silicone rubber or permeable poly tetra-fluoroethylene (PTFE). The housing 40 may further incorporate a stiffening structure such as a wire mesh. The sensor 22 is disposed within the housing 40, and may be secured to the housing 40 by means of a bracket 27. In this arrangement, the constituent gas (carbon monoxide) can permeate at any permeable portion of the housing 40, and the sensor 22 can then detect the constituent gas within the housing 40. This arrangement essentially creates a large sensor interface 24. While this arrangement is more resistant to complete blocking of gas to the sensor 22, it may not respond as quickly to the presence of the constituent gas in the oral cavity. However, certain gas constituents such as carbon monoxide may require the detection of only trace quantities to indicate that the user is smoking.

FIG. 10C shows an alternative sensor interface 24. This arrangement is essentially identical to that shown in FIG. 10A, with the addition of a housing membrane 29 across the opening 25 in the housing 40. For sensors that are sensitive to being covered or directly exposed to liquid water, housing membrane 29 prevents such exposure. Housing membrane 29 may be fabricated from any gas permeable material, such as silicone rubber or permeable PTFE. As with the configuration of FIG. 10B, this arrangement may be slower to respond to the presence of the constituent gas in the oral cavity, but depending on the constituent gas, this may still be sensitive enough to detect the smoking behavior.

From the foregoing, it will be apparent to those skilled in the art that the present invention provides, in exemplary no-limiting embodiments, an intraoral aversion device. Further, those skilled in the art will recognize that the present invention may be manifested in a variety of forms other than the specific embodiments described and contemplated herein. Accordingly, departures in form and detail may be made without departing from the scope and spirit of the present invention as described in the appended claims.

What is claimed is:

1. A device for determining when a user engages in smoking facilitated via the user's oral cavity, comprising:

a housing configured to be installed in the oral cavity;

means, coupled to said housing, for fixing said housing to the user's teeth or bony structure in the oral cavity such that it is difficult for the user to remove the device him- or herself;

a detector configured to detect a parameter indicative of the user smoking, the detector disposed in the housing in the oral cavity; and an output device configured to deliver a stimulus, said output device in communication with said detector and said output device being disposed within the oral cavity.

2. A device for determining when a user engages in smoking facilitated via the user's oral cavity according to claim 1, wherein said attachment means includes bone screws connected to said housing.

3. A device for determining when a user engages in smoking facilitated via the user's oral cavity according to claim 1, wherein said attachment means is selected from a group consisting of: a tooth clasp affixed with an adhesive product, a bonding agent, a modified bridge, a modified crown, a tooth band on a molar or bicuspid tooth, an interdental wire, an interdental band and a labial bow wire.

4. A device according to claim 1, wherein said output device is configured to deliver a negative stimulus.

5. A device according to claim 1, wherein said output device is configured to deliver a stimulus within the oral cavity.

6. An aversion device as in claim 1, wherein the housing is impermeable to liquid.

7. An aversion device as in claim 1, wherein the detector includes a sensor selected from the group consisting of a gas sensor, a particulate sensor, a chemical reagent sensor, and a spectrometer.

8. An aversion device as in claim 1, wherein the output device is at least partially disposed in the housing.

9. An aversion device as in claim 1, wherein the stimulus delivered by said output device is selected from the group consisting of an electrical stimulus, a mechanical stimulus, a chemical stimulus, a thermal stimulus, an audible stimulus, and a visible stimulus.

10. A device according to claim 1, wherein said detector is configured to detect the presence of a constituent of tobacco smoke when the constituent is at a level higher than ambient when the use engages in tobacco smoking.

11. A device according to claim 1, wherein the detector is configured to detect the presence of a constituent selected from a group including: carbon dioxide, carbon monoxide, nitrogen oxides, ammonia, nicotine, acetone, acetaldehyde, formaldehyde, hydrogen cyanide, isoprene, methyl ethyl ketone, benzene, toluene, phenol, and acrylonitrile.

12. A device according to claim 10, wherein the detector is an electrochemical gas sensor.

13. A device according to claim 12, wherein the electrochemical gas sensor is configured to detect carbon monoxide.

14. An aversion method for a user engaging in smoking facilitated via the user's oral cavity, comprising the steps of:

a) providing:

a housing configured to be installed in the oral cavity;

means, coupled to said housing, for fixing said housing to the user's teeth or bony structure in the oral cavity such that it is difficult for the user to remove the device him- or herself;

a detector configured to detect a parameter indicative of the user smoking, the detector disposed in the housing in the oral cavity; and an output device in communication with said detector, said output device being disposed within the oral cavity and configured to deliver a stimulus;

b) positioning at least the detector in the oral cavity of the user;

c) detecting a parameter indicative of the user smoking; and d) delivering a stimulus in response to the detector detecting smoking.

15. An aversion method as in claim 14, wherein the stimulus delivered by the output device is selected from the group consisting of an electrical stimulus, a mechanical stimulus, a chemical stimulus, a thermal stimulus, an audible stimulus, and a visible stimulus.

16. An aversion method as in claim 14, wherein the stimulus is variable.

17. An aversion method as in claim 14, wherein the stimulus is delivered when the detected parameter exceeds a threshold.

18. An aversion method as in claim 14, wherein the stimulus is delivered when a time rate of change of the detected parameter exceeds a threshold.

19. An aversion method as in claim 17, wherein the threshold is fixed.

20. An aversion method as in claim 17, wherein the threshold is variable.

21. A method as in claim 14, wherein the parameter is a constituent of smoking and wherein that constituent is at a level higher than ambient when the user engages in tobacco smoking.

22. A method as in claim 21, wherein the constituent is selected from the group including carbon dioxide, carbon monoxide, nitrogen oxides, ammonia, nicotine, acetone, acetaldehyde, formaldehyde, hydrogen cyanide, isoprene, methyl ethyl ketone, benzene, toluene, phenol, and acrylonitrile.

23. A method as in claim 21, wherein the detector comprises an electrochemical gas sensor.

24. A method as in claim 23, wherein the electrochemical gas sensor detects carbon monoxide.

25. A method according to claim 14, wherein the output device provided is configured to deliver a negative stimulus.

26. A method according to claim 14, wherein the output device provided is configured to deliver a stimulus within the oral cavity.

* * * * *

UNITED STATES PATENT AND TRADEMARK OFFICE

CERTIFICATE OF CORRECTION

PATENT NO. : 7,610,919 B2
APPLICATION NO. : 10/943379
DATED : November 3, 2009
INVENTOR(S) : Utley et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 709 days.

Signed and Sealed this

Twelfth Day of October, 2010

David J. Kappos

David J. Kappos
*Director of the United States Patent and Trademark Office*